United States Patent [19]

Nelson

[11] 4,418,872

[45] Dec. 6, 1983

[54] FEEDER/CRUSHER MACHINE

[75] Inventor: Robert C. Nelson, Bluefield, W. Va.

[73] Assignee: Baker Mine Services, Inc., Glen Lyn, Va.

[21] Appl. No.: 213,413

[22] Filed: Dec. 5, 1980

Related U.S. Application Data

[63] Continuation of Ser. No. 55,684, Jul. 6, 1979, abandoned.

[51] Int. Cl.[3] ..... B02C 13/20

[52] U.S. Cl. ..... 241/187; 241/101.7; 241/190; 241/205; 241/206; 241/266

[58] Field of Search ..... 241/186 R, 186.2, 101.7, 241/187, 189 R, 190, 202, 204, 206, 265, 266, 219, 205, 235, 236, 227, 185 R

[56] References Cited

U.S. PATENT DOCUMENTS

| | | | |
|---|---|---|---|
| 350,814 | 10/1886 | Coxe | 241/235 |
| 3,556,415 | 1/1971 | Winter | 241/202 |
| 4,073,445 | 2/1978 | Clonch | 241/101.7 |
| 4,172,561 | 10/1979 | Parrott | 241/186 R |
| 4,192,471 | 3/1980 | Beckman et al. | 241/185 R X |

*Primary Examiner*—Mark Rosenbaum

*Attorney, Agent, or Firm*—McCaleb, Lucas & Brugman

[57] ABSTRACT

A feeder/crusher machine for use in underground coal or ore mines for receiving and crushing mined material and feeding the crushed product to a stationary conveyor in the mine material transport system. It comprises a tramming unit supporting a feeding and crushing unit having an elongated body with a crushing section located intermediate receiving and discharge sections at opposite ends of the body. A conveyor has an upper, carrying run movable through the crushing section in a horizontal plane. A pair of breaker drums are mounted immediately above the conveyor in the crushing section and are rotatable about transversely spaced, parallel vertical axes. Because the breaker drums are rotatable about vertical axes, teeth on their peripheries move horizontally, parallel to the plane of the conveyor carrying run. Further, the teeth move in the same direction as the conveyor at the location between the drums where crushing occurs. Thus, crushing forces are confined to the material being crushed and are not transmitted destructively to the conveyor chains or flights.

6 Claims, 8 Drawing Figures

22
94
130
112
132
134
96
148
152
143
120
98
146
144
142
60
62
116
150
140
94a
36
136
102
138
110
137
50
106a
106
137
138
106a
110
170
169
136
168
94a
36
116
63
62
7.
7.
60
174
166
162
184
T
164
156
REL
A
C
B
112
172
120
100
134
132
176
178
P
182
130
180
186
154
158
160
24
94

94
130
98
120
112
148
150
140
143
60
144
63
62
116
110
94a
101
106a
106
137
50
101
106a
110
170
169
94a
168
62
60
116
156
T
120
112
100
130
172
174
154
P
182
158
160
94
24

FEEDER/CRUSHER MACHINE

This application is a continuation of application Ser. No. 55,684, filed July 6, 1979 now abandoned.

BACKGROUND OF THE INVENTION

The field of the invention is feeder/crushers for use in underground coal mines and the like. It is concerned particularly with such a machine in which crushing forces are applied to material between a pair of vertical breaker drums and not to the conveyor chain. The invention is also concerned with such a machine in which the crushed product size can be changed by adjusting the horizontal space between the breaker drums. The capability of adjusting the size of the crushed product without moving the breaker drum vertically is a special advantage for machines designed to operate in low-clearance coal mines.

In coal mines, the coal often comes off the face in a wide variety of sizes, some too large to be carried on the conveying system. To reduce such coal to a manageable size consist, feeder/crusher machines are employed to receive as-mined coal from a mining or loading machine or a haulage vehicle, crush the large lumps to a manageable size, and feed it to a main line conveyor for movement out of the mine.

Conventional feeder/crushers are self-propelled machines with a double strand chain flight conveyor continuously moving along the floor of the body to move as-mined coal from a receiving section to a rotary crusher and then move the crushed product to a discharge section from which it is loaded over the end or side of a conveyor which may be one of a series of conveyors leading to the mine portal. Typically, in conventional room and pillar mining, the feeder/crusher machine may be located to discharge onto one of the stationary conveyors located nearest the face being mined. One or more haulage vehicles such as shuttle cars, ram cars or scoops will carry the freshly mined coal to the feeder/crusher machine.

Typical feeder/crusher machines are shown in Long U.S. Pat. No. 3,016,204 and Clonch U.S. Pat. No. 4,073,445. Actual commercial feeder/crusher machines being marketed in the United States are shown in the April, 1976 issue of "Coal Age" as follows: Page 15, Long-Airdox Company; Page 173, Owens Manufacturing, Inc.; Page 231, The W. R. Stamler Corporation; and Page 269, S & S Corporation. A feeder/crusher marketed by Continental Conveyor & Equipment Company, Inc. is illustrated on pages 160 and 263 of the September, 1978 "Coal Age".

All these conventional feeder/crusher machines are of the same general construction. They all have a horizontal breaker drum or rotary crusher mounted at a fixed or variable distance above the floor of a chain flight conveyor running along the floor of a conveyor trough. Typically, the breaker drum is of the hammer mill or impact type in which a horizontal rotating shaft is provided along its length with a plurality of radial striker arms or hammers. The shaft is disposed transversely of the body of the machine, and as the coal is moved into the striker arm or hammer circle between the shaft and floor of the conveyor trough, by the conveyor flights, it is struck and crushed. Unfortunately, in these conventional machines, the crushing forces are also directed downward against the conveyor flights and chains and replacement and repair of these parts create the need for costly and time consuming maintenance and down time.

No two coal seams are alike. Some are fairly homogenius with uniform fracture planes and are readily cut or shot off the face in maximum lump sizes which can be easily handled by the mine conveyor system. Other coals are rashy, being interspersed or interbedded with shales and clays, causing them to come off the face in slabs and blocks which have to be broken down before they can be carried on a conveyor. Still further, there are often substantial changes from one location to another in the same seam.

Coal seams also vary widely in methane content, trapped in the form of gas within the coal structure from primordiol times. In such mines, some care has to be taken in crushing the coal to avoid releasing so much methane that as it raises the proportion in the air to an explosive level. Where a mine is so "hot" with methane being released from the mined coal, it is desirable not to aggravate safety of the atmosphere by breaking up any more coal chunks or slabs than is absolutely necessary. For example, in an area near Grundy, W. Va., there is a commercially mined coal seam which is so "hot" with methane that a continuous miner can sump in only 18 inches before it has to back up and move over to let the methane clear out of the mine air stream. This particular seam also has irregular concentrations of rashy coal which comes down in large blocks and slabs. Here is a prime example of need for a feeder/crusher which is adjustable between a non-operating load in which it merely passes the mined material through without crushing, and a crushing mode in which the mined coal is crushed just sufficiently to carry it on the conveyor without crushing it to the point where excessive amounts of methane are released.

Thus, conventional feeder/crusher machines have certain drawbacks when used in underground coal mines. The rotary crusher is horizontal and directs the crushing forces to the conveyor flights and chains causing breakage. And the rotary crusher is positioned at a fixed spacing from the conveyor, incapable of being adjusted to vary the maximum sizes of crushed product. Further, inasmuch as the rotary crusher is horizontal, there are low-clearance head room conditions in many mines which make it impossible to lift the rotary crusher to an inoperative position without interfering with the mine roof.

SUMMARY OF THE INVENTION

A broad object of the invention is to provide a feeder/crusher machine having breaker drum means rotatable by power about an axis normal to the plane of the conveyor carrying run and having breaking elements on the periphery thereof movable with the drum in a direction parallel to the plane of the carrying run to enable transmitting crushing stresses from the breaking elements to the material being crushed without transmitting destructive forces to the conveyor.

Another object is to provide a feeder/crusher having a pair of breaker drums rotatable about spaced parallel vertical axes normal to the plane of the conveyor carrying run, the breaker drums being disposed immediately above the conveying run and having breaker elements on the peripheries thereof rotatable in horizontal planes to apply crushing stresses to material being conveyed by the conveyor through the space between the drums without transmitting such stresses to the conveyor.

Another object is to provide such a feeder/crusher in which at least one of the breaker drums is adjustably mounted to vary the space between the drums and thereby regulate the degree of reduction in size of the crushed product.

Another object is to provide such a feeder/crusher with a connection between one drum and the body which is yieldable in response to a predetermined force applied to the drum by material being crushed thereby enabling the drum to move away from the other drum when non-crushable foreign material such as tramp iron is caught in the space between the breaker drums.

Another object is to provide such a feeder/crusher in which the yieldable connection comprises a hydraulic overload release mechanism including a hydraulic cylinder and piston, and a relief valve connected to the cylinder effective to release fluid from the cylinder in response to a predetermined force applied to the drum by the material being crushed.

Another object is to provide such a feeder/breaker with a body having upstanding sidewalls extending along receiving and discharge compartments which are located fore and aft of a crushing section, gaps in the sidewalls adjacent the crushing section, and breaker drums mounted on arms pivotably supported on the body on opposite sides of the crushing section, with vertical guide plates mounted on and movable with the arms within the gaps extending downward into close proximity with the carrying run of the conveyor to prevent loss of material through the gaps.

Another object is to provide such a feeder/crusher having power operated means for continuously oscillating the breaker drums toward and away from one another for improved cutting and crushing action on the material being conveyed.

Another object is to provide such a feeder/crusher having vertical breaker drums mounted on horizontally swingable arms and manually operated control means for adjusting the space between the drums to thereby regulate the degree of reduction in the size of the crushed product.

BRIEF DESCRIPTION OF THE DRAWINGS

Other objects and advantages will be apparent from the following more detailed description taken in connection with the drawings in which.

Like parts are referred to by like reference characters throughout the figures of the drawings.

Figures 1, 2:
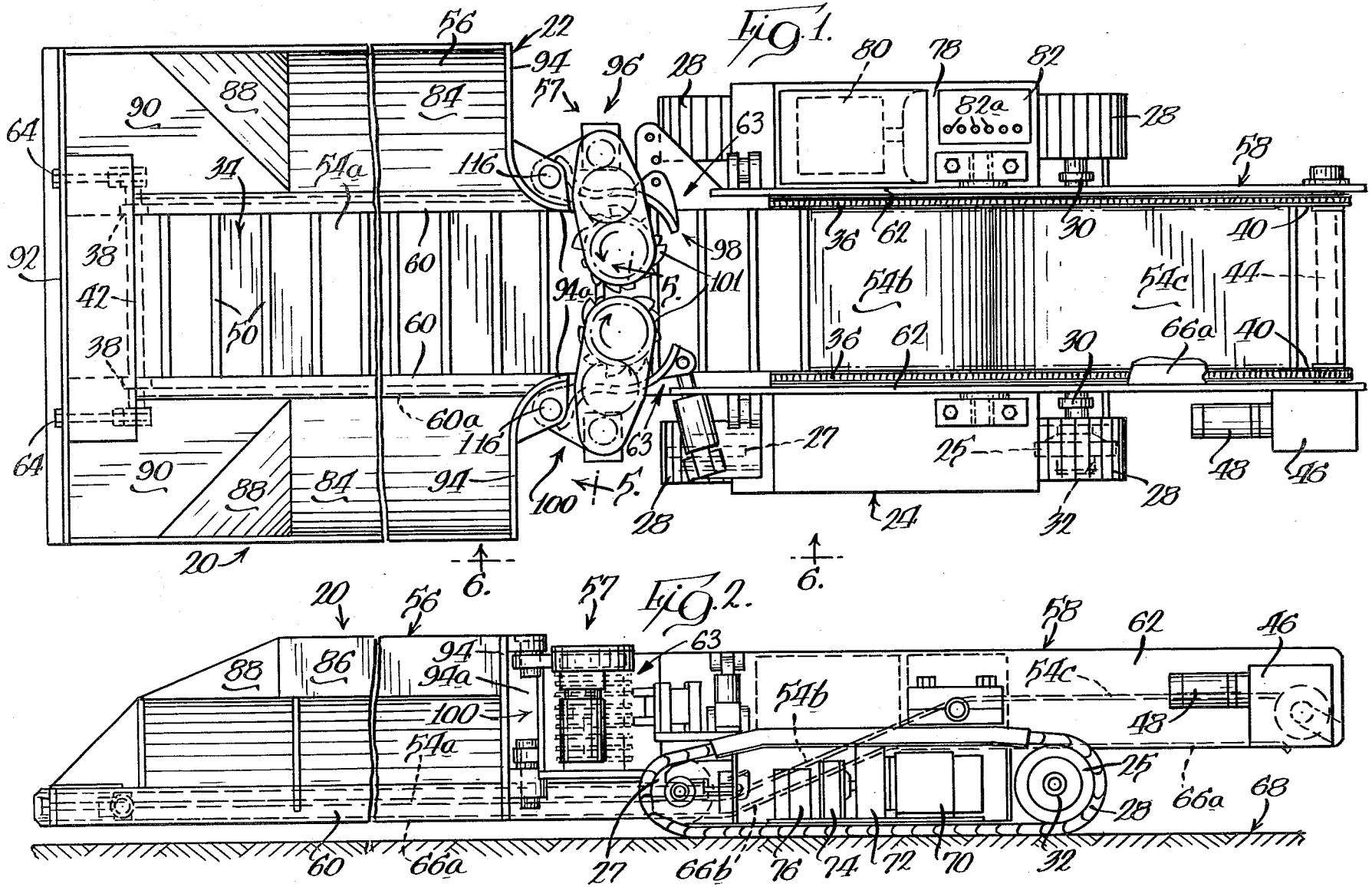
FIG. 1 is a top, plan view of a machine illustrating a preferred form of the present invention.
FIG. 2 is a left side view of FIG. 1.

Referring now more specifically to the invention shown in the drawings, the improved feeder/crusher generally designated 20 comprises a feeding and crushing unit 22 pivotally adjustably mounted on a tramming unit 24.

The tramming unit 24 comprises a frame 26, with endles crawler treads 28 on opposite sides. These are trained about end sprockets 25 and 27 in the usual way, each being independently driven through a variable speed electrical or hydraulic motor 30 through a speed reducer 32. The usual controls (not shown) are provided for energizing the crawler motors 30 simultaneously in either direction for straight line movement, or individually or in opposite directions for turns.

An endless, double-strand chain conveyor 34 comprises a pair of conveyor chains 36, 36, trained for orbital movement between front and rear sprockets 38, 38 and 40, 40 respectively. The front sprockets are interconnected by an idler cross shaft 42. The rear sprockets are interconnected by a drive cross shaft 44 and driven through a right angle reducer 46 by a hydraulic drive motor 48. Transverse conveyor flights 50 are connected at their ends to the chains and comprise an upper, carrying run 52 and a lower, return run 53. The carrying run 52 moves rearwardly along a floor plate 54, from a receiving section 56 through a crushing section 57 and a discharge section 58. The floor plate 54 has a forward horizontal section **54*a* in receiving section 56; and an ascending section 54*b* and an upper level, rearward horizontal section 54*c* in the discharge section 58. The sections of the floor plate 54 are fastened, as by welding, between a pair of channel members 60, 60 in the receiving section, and a pair of side plates 62, 62 in the discharge section. In the construction illustrated, the plates 62 comprise rearward extensions of the webs 60*a* of the channel members 60**.

The front cross shaft 42 for the conveyor is mounted for fore and aft adjusting movement to keep the conveyor chains properly tensioned, by means of conventional adjustment screws 64, 64.

After the conveyor reverses direction about the rear, drive sprockets 40, the return run 53 is guided along pairs of horizontal guide strips **66*a* and descending guide strips 66*b* in the discharge section; and horizontal guide strips 66*c* in the receiving section. As shown in FIG. 2, this two-level arrangement for the conveyor enables the discharge section 58 to be at a substantial height above the floor or ground level 68** so it can readily overhang a discharge point such as a stationary main conveyor.

The tramming unit 24 has within the left hand crawler frame a main electric drive motor 70 connected through speed reducers 72, 74 to a hydraulic pump 76. Within the right hand crawler there is another electric drive motor 78. This drives another pump 80. By means of a control station 82, having individual control knobs **82*a*, hydraulic fluid can be directed as desired between pumps 76 and 80, tramming motors 30, 30, conveying motor 48**, and any other mechanisms operated by hydraulic pressure.

The receiving section 56 is constructed to hold a large load so it will function somewhat as a surge bin, smoothing out flow from an intermittent upstream source to the downstream conveyor system into which it discharges. The receiving section has a pair of outwardly flared side plates 84, 84 extending upwardly from the channel members 60 to vertical sideboards 86. The forward end of the receiving section is fabricated of angular sheet metal sections 88 and 90 which terminate in a low bumper 92 adapted to fit beneath the discharge boom of a haulage vehicle; at the other end, the receiving section is closed on each side by a curved vertical plate 94 having a rearwardly extending curved portion 94a (see FIG. 3).

The heart of the invention is the breaker arrangement generally designated 96. This comprises a pair of breaker units, a right hand unit 98, and a left hand unit 100.

Figure 5:
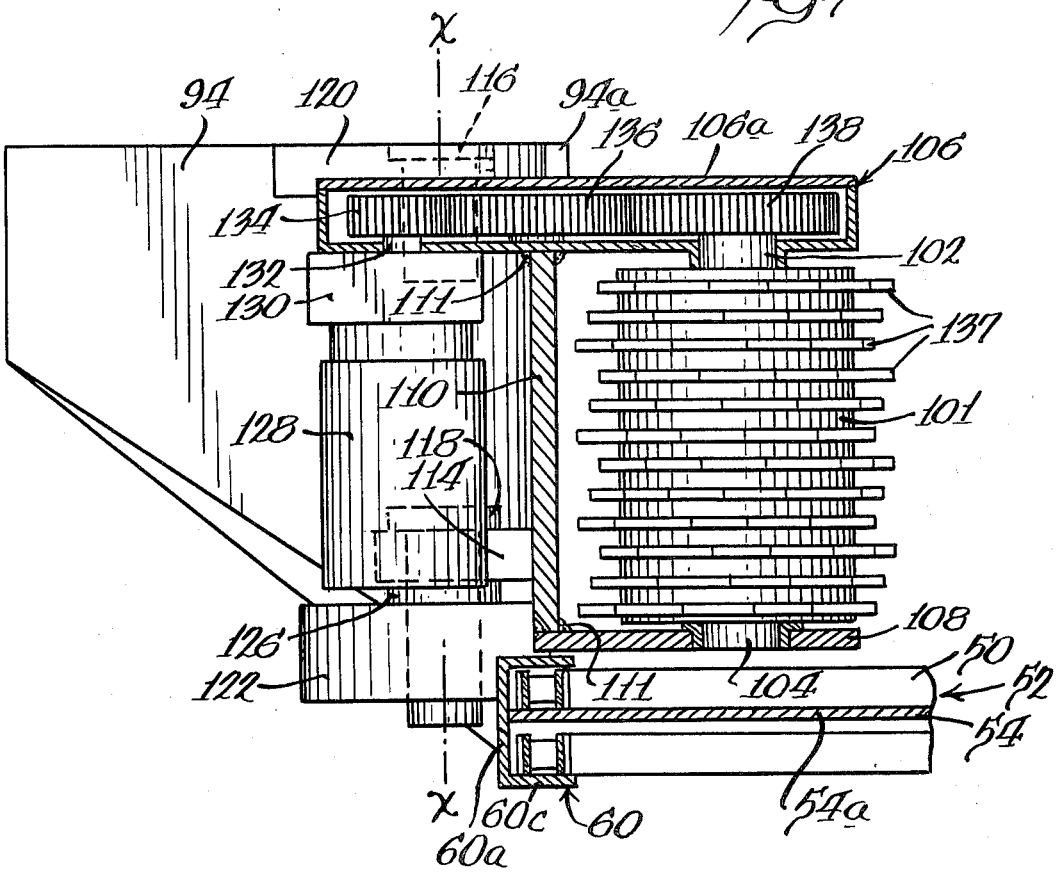
FIG. 5 is an enlarged, vertical, cross-sectional view of FIG. 1, taken along the line 5—5.

Each of these breaker units 98 and 100 includes a vertical breaker drum 101 with upper and lower end shafts 102 and 104 rotatably journaled respectively in an upper arm comprising a gear housing 106, and in a lower arm 108. Breaker elements 137, representing teeth or hammers or the like are positioned around the periphery of each drum. A generally S-shaped guide plate 110 is fastened as by welding 111 (see FIG. 5) to the bottom of the gear box housing 106 and to the top of arm 108 to provide a rigid, unitary breaker unit. Guide plates 110 are positioned in gaps 63 in the side walls on opposite sides of the crushing section. Upper and lower pivot arms 112 and 114 are fastened respectively to the gear box 106 and the outside of the guide plate 110. Upper and lower pivot pins 116 and 118 respectively are supported on upper and lower bosses 120 and 122 affixed as by welding to the backside of the corresponding receiving section vertical plate 94. Thus, breaker units 98 and 100 are horizontally swingable about spaced, parallel vertical axes X—X. Spacers 124, 126 are provided on the pins 116, 118 to adjust the relative vertical heights of the parts.

Each of the breaker units 98 and 100 has a breaker drum drive motor 128 and a speed reducer gear box 130 with an output shaft 132 connected to drive pinion 134 in upper gear housing 106. Pinion 134 drives an intermediate reach gear 136 which in turn drives main gear 138 fastened to drum end shaft 102.

Each gear box housing 106 has a top cover plate 106a suitably fastened by bolts (not shown). The structure so far described for the breaker units 98 and 100 is common to them both and will cause the drums 101 to rotate in opposite directions indicated by the curved arrows in FIG. 1. In the paraticular embodiment illustrated, there are specific differences which will now be described.

Figure 3:
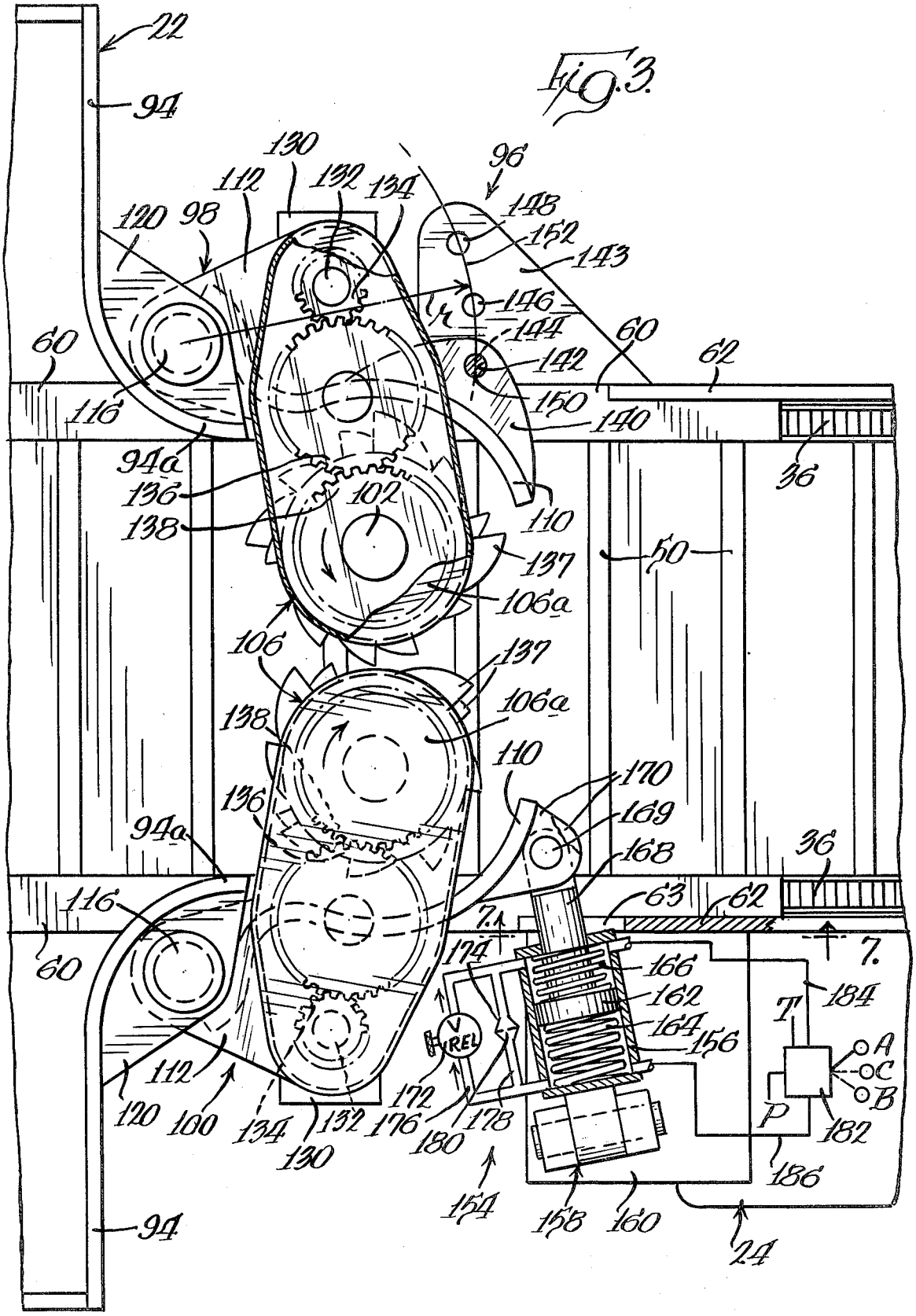
FIG. 3 is a fragmentary enlarged view of FIG. 1 showing the breaker drums adjusted to their closest proximity position.

Referring first to the right hand breaker unit 98, the guide plate 110 has, along its lower edge, a flange 140 with an opening 142. This is swingable with the guide plate 110 across a stationary plate 143 fastened as by welding to the outside of the right hand channel member 60. Plate 143 has a plurality (in this case three) of openings 144, 146 and 148. This enables the right hand breaker unit 98 to be spaced varying distances from the left hand unit 100 to adjust the coarseness of the broken product. It also provides a readily accessible shear pin 150 which will break and prevent damage to the working parts when non-crushables such as tramp iron passes through. For example, as shown in FIGS. 1 and 3, right hand breaker unit 98 is held in closest proximity to left hand unit 100 when shear pin 150 extends through opening 144. This produces minimum size crushed product for discharge from the machine. In FIG. 3, right hand unit 98 is spaced farthest from unit 100 when shear pin 150 extends through opening 148. Even in the closest proximity position of FIGS. 1 and 3, the breaker elements on the respective drums are spaced some distance apart to provide a nip space between the drums for coal or mineral to be seized by the breaker elements and crushed into lumps by horizontal forces reacting solely between the drums and not against the conveyor carrying run 52.

Figure 4:
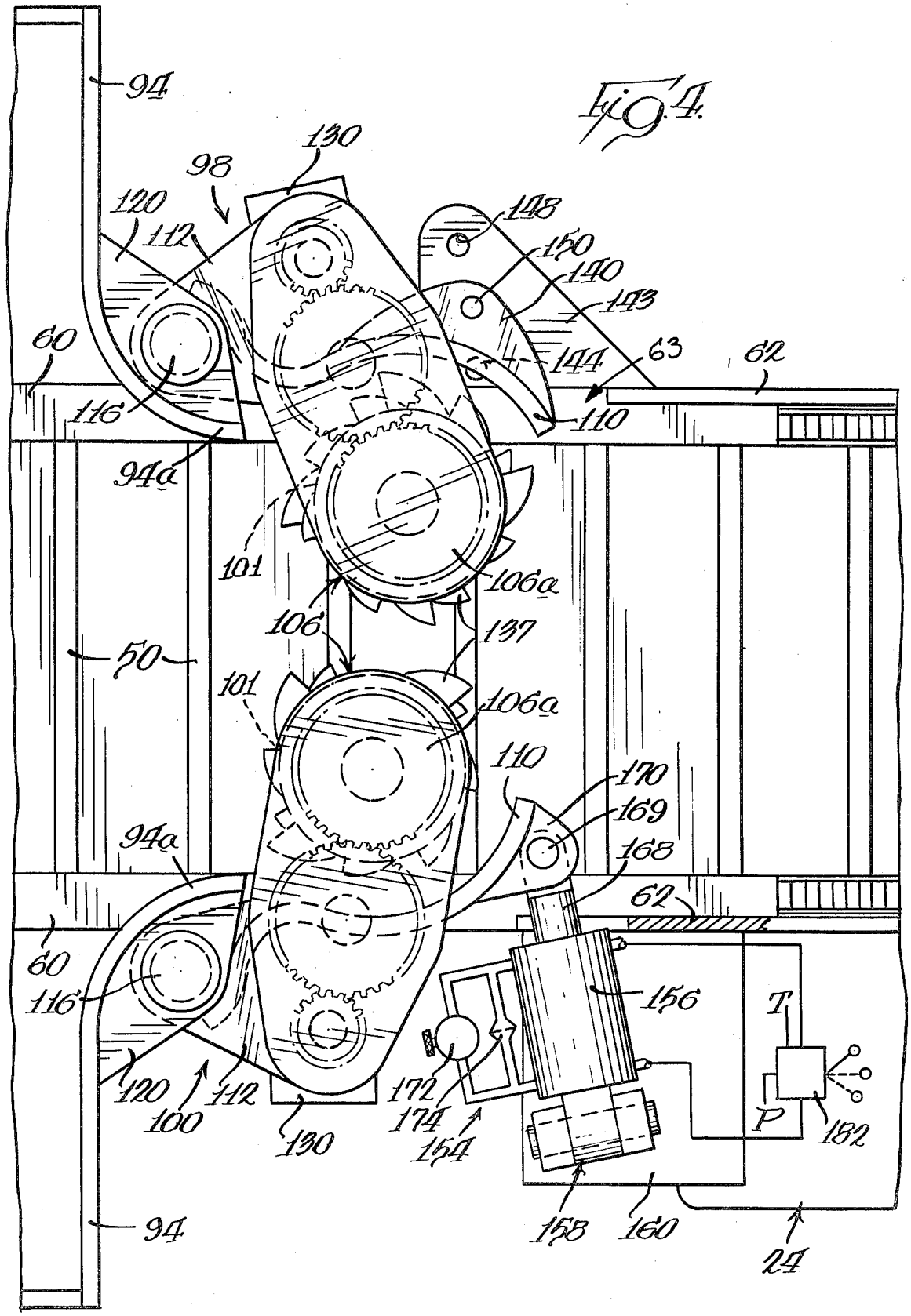
FIG. 4 is similar to FIG. 3 with one of the breaker drums adjusted to a new position to increase the spacing between the breaker drums.

As best shown in FIGS. 3 and 4, openings 142, and 144, 146, 148, extend along a common arc 152 struck by radius r from the center line X—X of the right hand pivot pins 116 and 118.

Referring now to the left hand breaker unit 100, it has a hydraulic overload release mechanism generally designated 154. This comprises a hydraulic cylinder 156 with its head end attached through a horizontally swingable and vertically tiltable connection generally designated 158 to a horizontal plate 160 fastened as by welding to the tramming unit frame 24. A piston 162 may normally be maintained in an intermediate position within the cylinder by a pair of opposed springs 164 and 166. The piston rod 168 is pivoted by pin 169 fastened to a pair of ears 170, 170 on the outside of the left hand guide plate 110. A relief valve 172 and an orifice valve 174, schematically shown in FIG. 3, are connected in parallel, in lines 176 and 178 respectively, between the ends of cylinder 156. Relief valve 172 is set to open and release fluid from the head end to the tail end of the cylinder when the unit is overloaded. When the overload passes, springs 164, 166 return the piston to its intermediate position while fluid returns through a small orifice 180 in valve 174.

For some operating conditions, it may be desirable to have both breaker units 98 and 100 equipped with the hydraulic overload release mechanism 154. While FIG. 3 shows a standard hydraulic cylinder 156, it should be understood that a hydraulic/air cylinder or a hydraulic/gas cylinder may be used, or opposed air or gas compartments may be substituted for the springs to return the piston 162 to normal, intermediate position.

A still further modification is illustrated in FIG. 3. An optional manual control valve 182 may be connected to the ends of the cylinder 156 via lines 184 and 186. The valve 182 is also connected to a P and a tank T. By moving the valve operating handle to position A or position B, fluid can be directed under pressure to one or the other ends of the cylinder 156 to move the piston 162 one direction or the other, overriding the resistance of the springs 164, 166. This will be useful when an operator desires to manually move the breaker unit for adjustment or inspection. When the operating handle is moved to its neutral or center position C, the hydraulic overload release mechanism 154 is able to function as described above, bypassing the valve 182 as though it did not exist.

Figure 8:
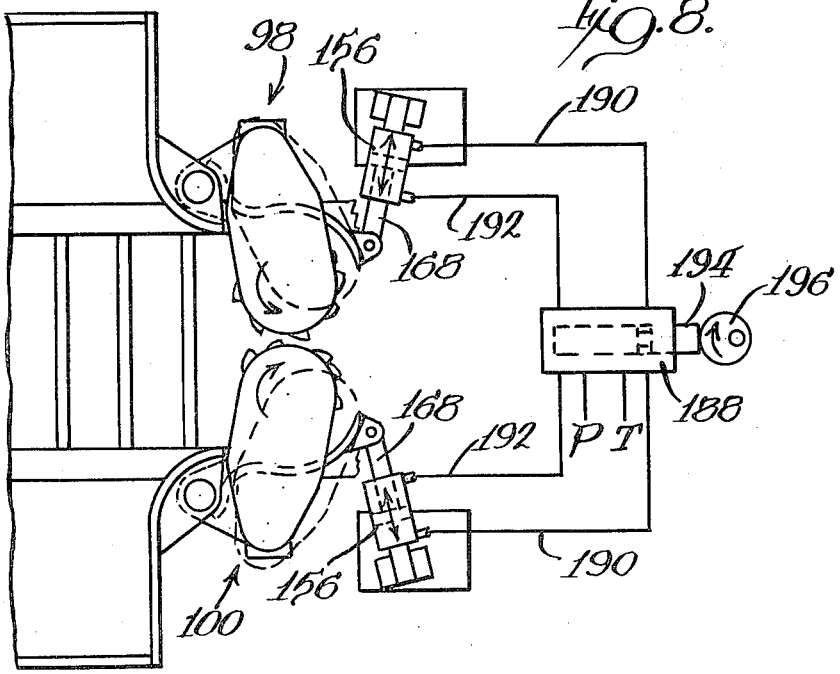
FIG. 8 is an alternate form of the invention.
Figure 6:
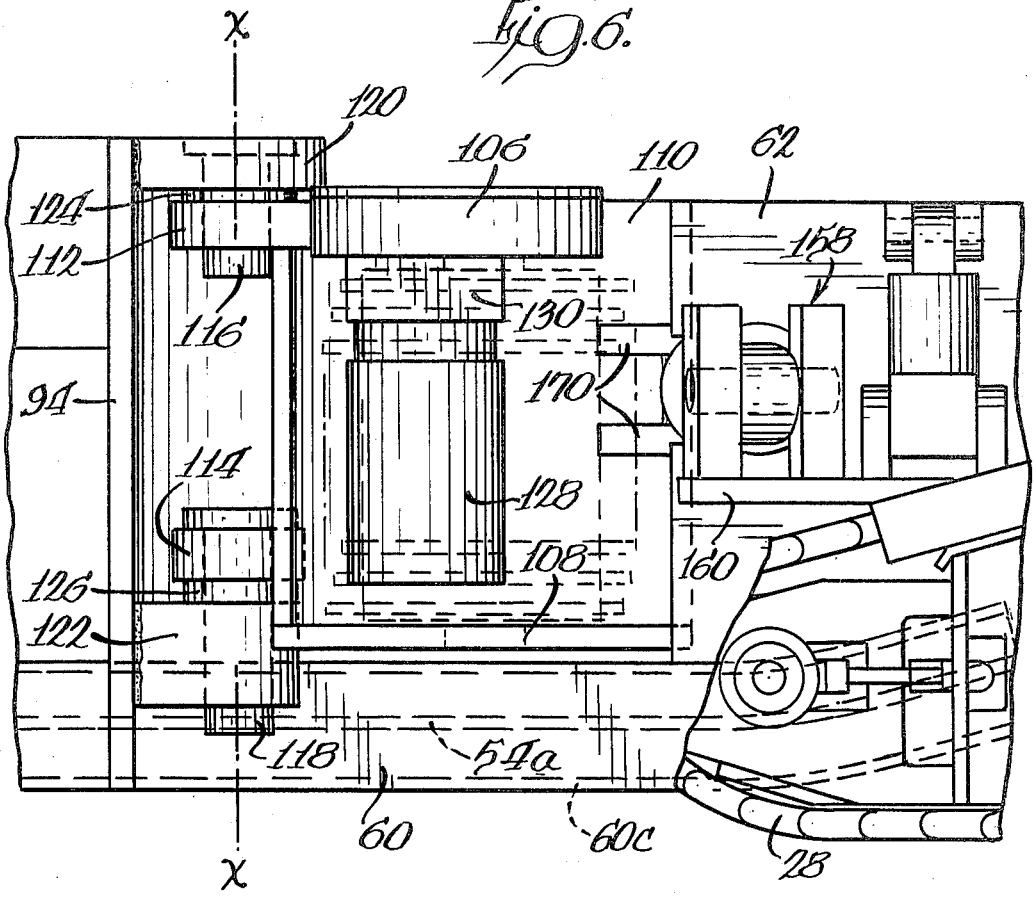
FIG. 6 is an enlarged fragmentary side view of FIG. 1 taken in the direction of the arrows 6—6.
Figure 7:
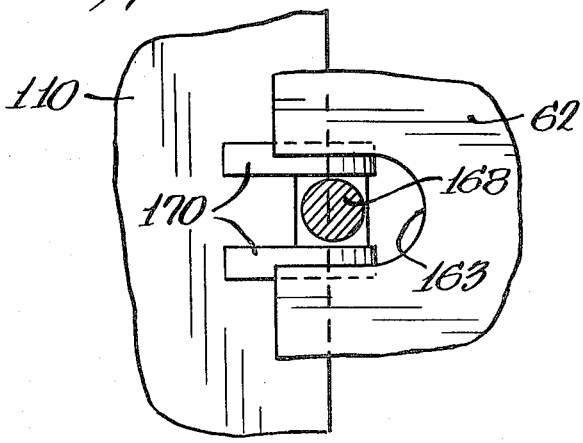
FIG. 7 is a fragmentary view of FIG. 3 taken along line 7—7.

One or both of the breaker units 98 and 100 may be made to oscillate continuously to produce a combined cutting and crushing action which will be advantageous for certain materials. This is illustrated in FIG. 8 where cylinders 156 and piston rods 168, similar to those previously described, are duplicated on opposite sides. A valve 188 is connected by lines 190, 190 to the head ends, and by lines 192, 192 to the rod ends of the cylinders 156. The valve 188 is also connected to a pump P and a tank T. A valve control slide 194 may be moved continously back and forth by a rotating cam 196 to oscillate the breaker units 98 and 100 between solid and broken lines as shown in FIG. 8.

Use and operation of the feeder/crusher machine 20 will be obvious to one familiar with underground coal mining. One example would be where the feeder/crusher is placed to discharge over the end or side of one of a series of stationary conveyors leading to the outside of the mine. Typically in conventional mining, it would be located within a few hundred yards of a mine face where coal is being removed by a continuous miner, or being picked up from the floor by a loading machine after a drilling and shooting cycle. The raw, as-mined coal is loaded into a shuttle car or other haulage vehicle and transported to the feeder/crusher where it is crushed and cut to a uniform maximum size as determined by the adjusted position of the left hand unit 98.

Another example of use would be in longwall mining where the feeder/crusher would be located between the discharge end of the armored conveyor running along the longwall face, and the stationary conveyor in the stable entry at the discharge end of that face.

If the coal at the mine face is excessively rashy, that is interlaid with shale, clay or rock, it may come off in large blocks and slabs which will be difficult to retain on troughed rubber conveyors which are the kind generally used for long distance hauling in underground mines. By using the feeder/crusher machine in such rashy applications, the raw, mined material can be broken up into sizes that can readily be handled by mine conveyors. If a mine is excessively gassy with methane, the condition can be exacerbated by crushing coal which does not necessarily need to be crushed, and thereby releasing additional volumes of methane into the air. Inasmuch as these rashy conditions change from location to location, it may be necessary to crush the as-mined material only as needed, thereby delaying the release of methane until it is transported out of the mine where this will be unobjectionable and harmless.

For such conditions where the need to crush the raw coal varies from seam to seam or from location to location within a seam, and where it in fact would be a disadvantage or even hazardous to crush coal unnecessarily for conveying purposes, the present invention has a substantial advantage in that the right hand breaker unit 98 may be positioned for a minimum size crushing operation by fitting shear pin 150 into the inner opening 144 as shown in FIG. 3, or it can be held in an open position where the shear pin 150 extends into opening 148.

In some applications, it is possible to operate for days in a wide open condition, as where shear pin 150 extends into opening 148, and then for a few feet of advance or a few minutes of operation, the face will become rashy and coal and rock will come off in large blocks and slabs requiring the feeder/crusher to be shifted to crushing mode. This can be done by moving the breaker unit 98 to the inward position as shown in FIG. 3 or, for a short period of time, the control valve 182 can be operated to move the breaker unit 100 closer to unit 98. Subsequently, when the mine face advances to an area where outsized blocks or slabs are not being produced, the valve 182 can be actuated to restore the unit 100 to a non-crushing position. The valve 182 has other uses, for example, to vary the spacing between the breaking units for inspection, repair, or to release a foreign object.

While the principles of the invention have been made clear in the embodiments illustrated and described, modifications for a specific environment and operating requirements can be made without departing from those principles.

The embodiments of the invention in which an exclusive property or privilege is claimed are defined as follows:

1. A feeder/crusher machine for use in underground mines comprising:

an elongated body with horizontally spaced receiving and discharge sections at opposite ends and a crushing section intermediate the receiving and discharge sections;

conveying means having a carrying run directly, horizontally movable from the receiving section through the crushing and discharge sections;

the receiving section having non-apertured floor portions including portions disposed outwardly of each side of the conveying means and upstanding sideboards along the outer edges thereof thereby functioning as a surge bin with the conveying run moving directly along the floor thereof, said receiving section having transverse vertical walls at the outlet end of the receiving section extending inwardly from the sideboards toward the conveying means to define a restricted outlet regulating the flow of material into the crushing section;

the crushing section having side walls with gaps therein and arms extending through said gaps;

a pair of breaker drums having peripheral breaker elements supported on said arms adjacent opposite sides of said crushing section immediately above and adjacent to said carrying run and continuously rotatable about spaced vertical axes in a direction to move coal or mineral material on the receiving sides of said drums toward the center of the crushing section, said drums being spaced apart to provide a nip space at the center of the crushing section between said peripheral breaker elements on the respective drums for coal or mineral material to be seized by said breaker elements and crushed into lumps determined by the size of the nip space by horizontal forces reacting solely between the drums and not against the conveyor means carrying run;

guide plates supported on said arms externally of the breaker drums and located in said gaps to prevent loss of material from the crushing section;

said breaker drums being sufficiently closely adjacent to the respective sides of the crushing section and to the carrying run to limit movement of material by the conveying means past the breaker drums only through the nip space, the movement of the breaker elements in the nip space being in the same direction as the carrying run;

power means for rotating said drums simultaneously to move the breaking elements on the nip sides of the drums in the direction of movement of the carrying run to move material from the receiving section through the nip space into the discharge section; and the portion of said conveying means in said receiving section being at a level closely adjacent the ground to maximize the volume of the receiving section for use as a surge bin, the portion of said conveying means in said discharge section being at a level substantially elevated above the ground so it can readily overhang a discharge point, and the intermediate portion of said conveyor means in said crushing section being inclined in a direction ascending from the level in the receiving section to the level in the discharge section.

2. A feeder/crusher machine for use in underground mines according to claim 1 in which said crushing section is part of a tramming unit having a frame ground-supported on tramming means for movement on a mine bottom.

3. A feeder/crusher machine according to claim 1 in which said arms are pivotably supported for horizontal movement relative to the body on opposite sides of the crushing section to vary the size of the nip space.

4. A feeder/crusher machine according to claim 3 including power means for swinging said arms, and manually operated control means for said power means to adjust the width of the nip space and thereby regulate the degree of reduction and size of the crushed product.

5. A feeder/crusher machine according to claim 1 in which the power means for rotating the drums includes motors carried by said arms and disposed outside the respective guide plates at substantially the same horizontal level as the drums.

6. A feeder/crusher machine according to claim 1 having power operated means for continuously oscillating said breaker drums toward and away from one another to continuously vary the width of the nip space between breaker elements on the drums for improved cutting and crushing action on the material being conveyed.

* * * * *